US007642478B2

(12) United States Patent
Courbon et al.

(10) Patent No.: US 7,642,478 B2
(45) Date of Patent: Jan. 5, 2010

(54) DEVICE FOR CONTROLLING AN ELECTRIC POWER CUTOFF DEVICE

(75) Inventors: Eric Courbon, Arpajon (FR); Jean-Pierre Dupraz, Bressolles (FR); Serge Poullain, Arpajon (FR); Sylvain Plante, Québec (CA); Jean-Luc Thomas, Fontainebleau (FR); Ernst Suter, Kölliken (CH); Robert Luscher, Seon (CH)

(73) Assignee: Areva T&D SA, Paris-la-Defense (FR)

( * ) Notice: Subject to any disclaimer, the term of this patent is extended or adjusted under 35 U.S.C. 154(b) by 0 days.

(21) Appl. No.: 10/586,295

(22) PCT Filed: Jan. 20, 2005

(86) PCT No.: PCT/FR2005/050030

§ 371 (c)(1),
(2), (4) Date: Jul. 13, 2006

(87) PCT Pub. No.: WO2005/076303

PCT Pub. Date: Aug. 18, 2005

(65) Prior Publication Data

US 2007/0163869 A1 Jul. 19, 2007

(30) Foreign Application Priority Data

Jan. 23, 2004 (FR) ..... 04 50124

(51) Int. Cl.
*H01H 5/00* (2006.01)

(52) U.S. Cl. ..... 200/400; 200/401

(58) Field of Classification Search ..... 200/400, 200/401, 409, 318.2, 323–325; 218/153, 218/154; 335/171
See application file for complete search history.

(56) References Cited

U.S. PATENT DOCUMENTS

| | | | | |
|---|---|---|---|---|
| 4,800,242 | A * | 1/1989 | Yin | 200/400 |
| 5,504,289 | A * | 4/1996 | Smith et al. | 200/400 |
| 6,917,006 | B2 * | 7/2005 | Bachofen | 200/400 |

FOREIGN PATENT DOCUMENTS

| | | |
|---|---|---|
| DE | 913 665 | 6/1954 |
| DE | 915 361 | 7/1954 |
| WO | WO 96/36982 | 11/1996 |
| WO | WO 00/05735 | 3/2000 |

* cited by examiner

*Primary Examiner*—Michael A Friedhofer
*Assistant Examiner*—Marina Fishman
(74) *Attorney, Agent, or Firm*—Nixon Peabody LLP

(57) ABSTRACT

A device for controlling a circuit-breaker intended for opening and closing this electric power cut-off device comprising a mobile contact, this control device comprising a motor with a rotary output shaft and being connected to power supply means and actuating means transforming the output displacement of the motor into a displacement of the contact, this device also comprising a mechanical spring arrangement involved in opening and closing the contact. The actuation means include a set of jointed elements providing the connection of the rotary shaft and of the ring, and, in the closed position of the contact, the set of jointed elements is near a dead centre position, a so-called open dead centre, the opening spring being only able to drive it towards the open position upon moving past this dead centre during opening.

19 Claims, 2 Drawing Sheets

DEVICE FOR CONTROLLING AN ELECTRIC POWER CUTOFF DEVICE

CROSS-REFERENCE TO RELATED APPLICATION

This application claims priority based on International Patent Application No. PCT/FR2005/050030 filed on Jan. 20, 2005, entitled "Control for Electric Power Interrupting Device" by Eric Courbon, Jean-Pierre Dupraz, Serge Poullain, Sylvain Plante, Jean-Luc Thomas, Ernst Suter, Robert Luscher, which claims priority of French Application No. 04 50124, filed on Jan. 23, 2004, and this application was not published in English.

TECHNICAL FIELD

The present invention relates to a device for controlling a high or medium voltage electric power cut-off device. By electric cut-off device, is generally meant here a circuit-breaker, a disconnector or a grounding device.

Such a control device is notably described in document WO 00/05735, WO 96/36922, or even DE913 665.

With the invention, the problem is posed of having a device for controlling a circuit-breaker provided with an improved arrangement for ensuring setting and maintaining the closed position of the mobile contact, notably by integrating a mixed solution which allows the use of a standard control aid motor, together with a mechanical spring arrangement involved in opening and closing the contact.

To do this, the object of the invention is a device intended for controlling a circuit-breaker, for opening and closing this electrical power cut-off device comprising a mobile contact, this control device comprising a motor with a rotary output shaft and being connected to power supply means and actuating means transforming the output displacement of the motor into displacement of the contact, a device also comprising a mechanical spring arrangement involved in opening and closing the contact, the spring arrangement including two pre-stressed and antagonist mechanical springs, a first spring, a so-called opening spring, providing the opening of the contact, and a second spring, a so-called closing spring, providing the closing of the contact, the actuating means being stressed by each of these two springs separated by a ring, and including an arrangement for immobilization in the open position and in the closed position of said contact. According to the invention, the actuating means include a set of jointed elements providing the connection of the rotary shaft and of the ring, and, in the closed position of the contact, the set of jointed elements abuts against an abutment element near a dead centre position, a so-called open dead centre, the opening spring is only able to drive it towards the open position upon moving past this dead centre during opening.

Thus, in the device according to the invention, when the mobile contact is in the closed position, it is maintained in this position owing to the fact that the set of jointed elements to which it is connected is blocked in one direction by its abutment against the abutment element, and also in the other direction because it has moved past the open dead centre and the opening spring can therefore no longer cause any displacement. In this position, moreover, it is the opening spring which ensures that the set of jointed elements is applied against the abutment element.

As this maintaining in the closed position is exclusively mechanical, it may therefore be retained in the case of failure of the electrical power supply of the motor.

Further, in the case of failure of the electrical mains or of the convertor, it nevertheless remains possible to open the circuit-breaker by means of the opening spring, after that the set of jointed elements have been caused to move past the open dead centre.

The required energy stored in banks of capacitors by means of this mixed solution, is four to six times less than that of an all-electric solution. This considerably reduces the cost and the bulkiness of these banks.

Also, a motor of lesser power is required. This electrical power is from four to ten times smaller than that required for the all-electric solution. A standard motor may be used without requiring any additional development for this application.

The same applies for the dimensioning of the power convertor. A low voltage convertor may be used with a bank of super capacitors as storage means.

As compared with a control solution exclusively with mechanical springs, the invention has the following advantages because of the presence of the motor.

The number of moving parts and mechanism connections is considerably reduced. This implies less friction losses and therefore the use of smaller springs. This also causes less frequent and less intensive maintenance.

As the compensation of losses is carried out during the opening or the closing, the circuit-breaker is always available and does not require a pause period after a given cycle of openings and closings. The springs do not need to be reloaded.

The closing of the circuit-breaker may be as fast as the opening because the mechanical energy contained in the closing spring when the circuit-breaker is in the open position is equal to that of the opening spring when the circuit-breaker is in the closed position.

According to a preferred embodiment of the invention, said motor is a motor for assisting and controlling the trajectory of said contact powered by a power convertor controlled by a position and speed regulator.

And advantageously, said regulator provides damping of the displacement of said contact at the end of the travel for opening and at the end of the travel for closing.

By means of the servo-motor, there is no longer any need for a damper at the end of travel, since the motor provides by its servo-control, the required damping to reach zero velocity at the end of travel.

The closed loop control of the trajectory increases the robustness of the circuit-breaker with regards to parametric variations such as, for example, the variation of the stiffness of the springs or the viscosity of the gas contained in the cut-off chamber depending on the temperature.

Preferably, said springs are mounted aligned along an axis, one of their respective ends abutting against a spring abutment and their facing ends being separated by said ring.

Preferably, said set of jointed elements comprises a crank driven into rotation by said output shaft and jointed at one end of a connecting rod, the other end of which is jointed on said ring.

Advantageously, in the open position of said contact, said set of jointed elements is near a dead centre position, a so-called closed dead centre, the closing spring only being able to drive it towards the closed position upon moving past this dead centre during closing.

Thus, once again here, when the mobile contact is in the open position, it is maintained in this position owing to the fact that the set of jointed elements to which it is connected is blocked in one direction by its abutment against the abutment element, and also in the other direction because it has moved past the closing dead centre and the closing spring can no longer cause any displacement. In this position, moreover, it is the closing spring which ensures that the set of jointed elements is applied against the abutment element. As this maintaining in the open position is exclusively mechanical, it may therefore be retained in the case of a failure of the electrical power supply of the motor.

Advantageously, said connecting rod has a U-shaped end providing its partial rotation around the axis of rotation of said crank.

Said crank may be driven into rotation by said output shaft via a meshed toothed segment on said output shaft and on which it is jointed.

According to an alternative, it includes an arrangement for disengaging the action of the closing spring.

Preferably, said disengaging arrangement consists of a device for controlled displacement of said abutment of the closing spring.

Advantageously, the control device comprises a device for pushing said set of jointed elements towards its opening dead centre.

Said pushing device may consist in a striker for stressing said crank.

Other advantages and features of the invention will become apparent in the non-limiting detailed description herein below.

DETAILED DESCRIPTION OF A PREFERRED EMBODIMENT

Figure 1:
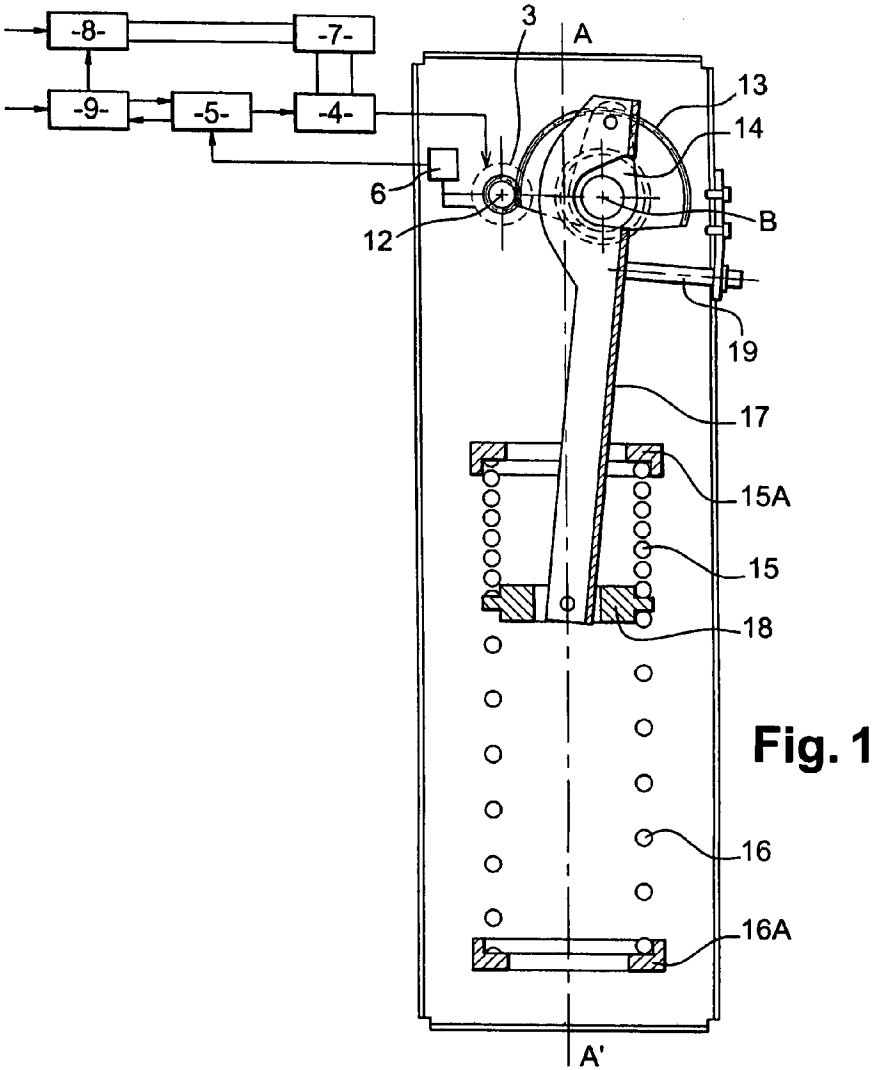
FIG. 1 is a longitudinal sectional view of a control device according to a preferred embodiment of the present invention, in the closed position of the mobile contact.
Figure 2:
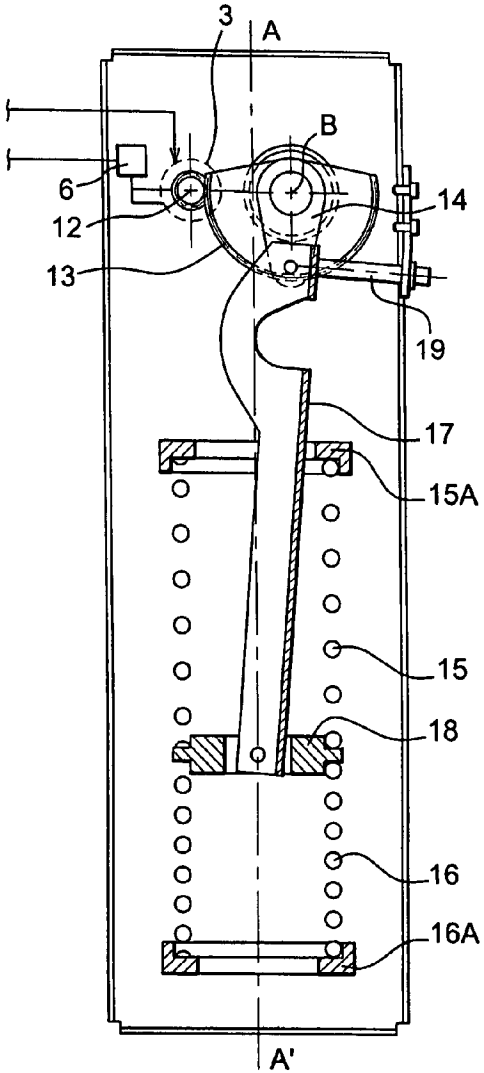
FIG. 2 is a longitudinal sectional view of a control device according to this preferred embodiment, in the open position of the mobile contact.

FIGS. 1 and 2 illustrate a circuit-breaker provided with a control device according to an embodiment of the present invention.

This circuit-breaker comprises a motor 3 for assisting and controlling the trajectory of a mobile contact (not shown) intended to cooperate with a fixed contact, here a motor 3 with a rotary shaft 12, connected to power supply means.

More specifically, these power supply means comprise a power convertor 4 controlled by a position and speed regulator 5 by means of a sensor 6 associated with the motor 3. The regulator 5 provides damping of the displacement of the mobile contact at the end of the travel for opening and at the end of the travel for closing.

A bank of capacitors 7 provides the instantaneous power required for powering the convertor 4. Management of recharging the capacitors is achieved with a charging unit 8 connected to a DC or AC electrical network. A unit 9 with inputs and outputs manages the speed and position references depending on the orders for opening or closing the circuit-breaker.

If reference is made to the direction as seen according to FIGS. 1 and 2, the A-A' axis of the control device is illustrated in a vertical position and the rotary shaft 12 of the motor 3 is positioned perpendicularly to this axis. These relative arrangements are exemplary embodiments, any other arrangements may be contemplated.

The mobile contact of the circuit-breaker is not illustrated and is connected in a way known per se to a crank 14 rotatable around an axis B parallel to the rotating shaft 12 and shifted from the A-A' axis. The drive of the crank 14 is achieved by means of a toothed segment 13 also rotatable around the B axis, jointed on the crank 14 and meshed on the output shaft 12. In an alternative not shown, the drive may be achieved by direct centering of the shaft 12 on the B axis.

The mechanical spring arrangement includes two pre-stressed mechanical springs, a first spring 15, a so-called opening spring, ensuring the opening of said contact and a second spring 16, a so-called closing spring, ensuring the closing of said contact, both of these springs being antagonists and with substantially identical stiffness. Pre-stressing both springs provides sufficient energy in the opening spring for performing an opening maneuver when the closing spring is released. It also provides their mechanical stability when the springs are in an equilibrium position.

The actuating means are stressed by each of both of these springs 15, 16 and include a set of jointed elements which will abut against an abutment element 19 in the open or closed position. These mobile/jointed elements are said crank 14 jointed at a first end of a connecting rod 17, the other end of which is jointed on a ring 18. This connecting rod 17 preferably has a U-shaped end ensuring its partial rotation around the axis of rotation B of the crank 14.

The springs 15, 16 are mounted aligned along the axis A-A', one of their respective ends abutting against a spring abutment 15A, 16A, and their facing ends being separated by said mobile ring 18.

In the closed position as illustrated in FIG. 1 and in the open position as illustrated in FIG. 2, the connecting rod 17 abuts against the abutment element 19.

In the closed position of the contact, the crank 14 is near an upper dead centre position, the opening spring 15 being only able to drive it towards the open position upon moving past this dead centre during opening. More specifically, in this closed position, the longitudinal axis of the connecting rod 17 connecting both joints has move past its secant position of the B axis towards the right.

The same applies in the open position as this is visible in FIG. 2. The crank 14 is near a lower dead centre position, the closing spring 16 being only able to drive it towards the closed position upon moving past this dead centre during closing. More specifically, in this open position, the longitudinal axis of the connecting rod 17 connecting both joints has moved past its secant position of the B axis towards the right.

An opening cycle is now described.

The mobile contact is in the closed position in a configuration such as illustrated in FIG. 1. When an opening order is transmitted, the motor 3 is active on a travel corresponding to moving past the dead centre specified above. The mechanical energy transfer is then carried out as soon as this dead centre has been passed, from the opening spring 15 towards the closing spring 16, the mechanical energy being transformed into kinetic energy and compressing the closing spring 16. The motor 3 provides the control of the trajectory of the mobile contact so that it arrives at the end of the travel for opening with zero velocity, as illustrated in FIG. 2.

A closing cycle is carried out in an analoguous way.

The mobile contact is in the open position, in a configuration such as illustrated in FIG. 2. When a closing order is transmitted, the motor 3 is active on a travel corresponding to moving past the dead centre as specified above. The mechanical energy transfer is then carried out as soon as this dead centre has been passed, from the closing spring 16 towards the opening spring 15, the mechanical energy being transformed into kinetic energy and compressing the opening spring 15. The motor 3 provides control of the trajectory of the mobile contact so that it arrives at the end of the travel for closing with zero velocity, as illustrated in FIG. 1.

Figure 3:
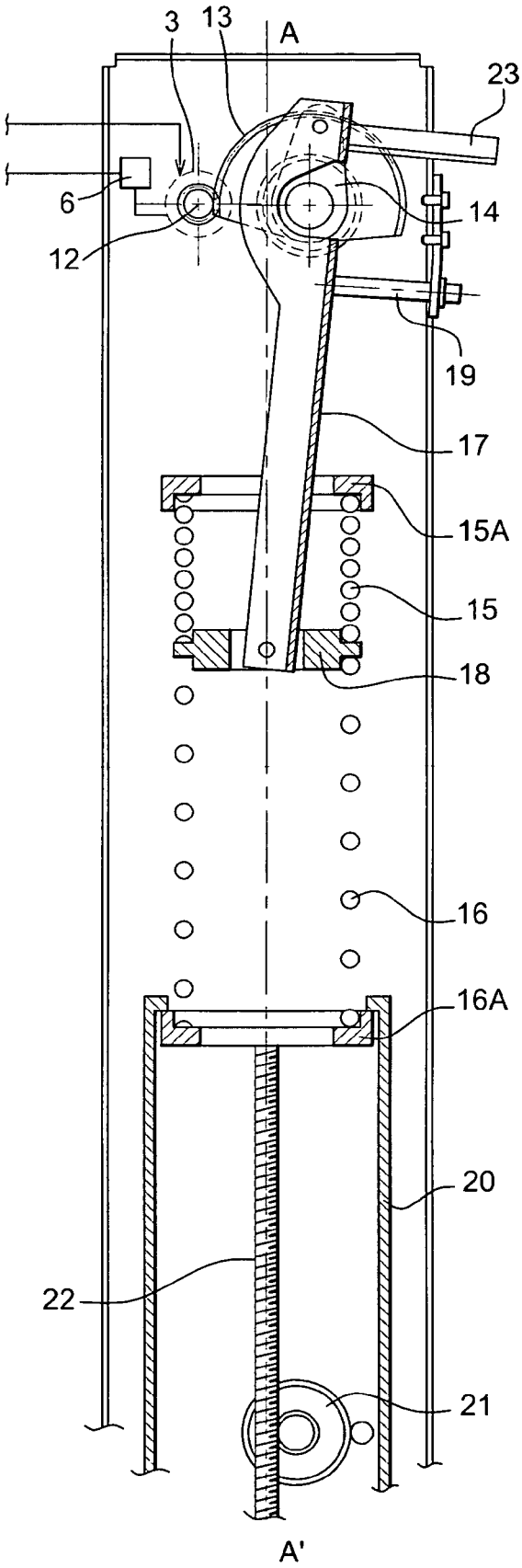
FIG. 3 is a longitudinal sectional view of an alternative of this embodiment, in the closed position of the mobile contact.

According to an alternative embodiment, the control device may comprise an arrangement for disengaging the action of the closing spring 16. This alternative is illustrated in FIG. 3.

This disengaging arrangement consists in a device for controlled displacement of the abutment 16A of the closing spring 16. To do this, this abutment 16A may be slid in a cylindrical guide 20 downwards, as seen according to FIG. 3. This displacement is controlled by an arrangement of gears 21 meshed on a toothed rod 22 integral with the relevant abutment 16A. This arrangement of gears 21 maintains the abutment 16A in an upper position as illustrated in FIG. 3, in normal operation.

Thus, in the case of failure of the motor 3, this disengaging arrangement is operated and the abutment 16A is moved downwards. The force of the pre-stressed closing spring 16, added to the gravitational force, suppresses any action from the closing spring 16. No action is then involved against the action of the opening spring 15.

A striker 23 is also provided, positioned in order to be able, when operating, to push the crank 14 so that it moves past its upper dead centre. By operating this striker 23, it is possible to open the contact, as soon as the closing spring 16 is disengaged. This striker 23 consists in a system transforming electrical energy into mechanical energy. This may be a coil actuating a lock releasing a spring or a solenoid.

As soon as the motor 3 is again in operation, the closing spring 16 is again compressed by the upward movement of the abutment 16A and the control device may resume its normal operation.

Of course, various modifications may be made by one skilled in the art to the device which has just been described exclusively as a non-limiting example.

The invention claimed is:

1. An apparatus configured to open and close an electric power cut-off device, the apparatus comprising:

a motor;

a crank assembly rotatable about an axis, wherein operation of the motor causes rotation of the crank assembly about the axis;

a connecting rod having a first end and a second end, the connecting rod coupled to the crank assembly proximal to the first end, wherein rotation of the crank assembly causes rotational and translational movement of the connecting rod between a first position and a second position;

a first stationary spring abutment positioned a first distance from the crank assembly;

a second stationary spring abutment position a second distance from the crank assembly, wherein the second distance is greater than the first distance, wherein the first and second spring abutments are stationary with respect to the connecting rod;

a mobile element coupled to the connecting rod proximal to the second end and moveable between the first and second stationary spring abutments, the mobile element coupled to the first stationary spring abutment via a first pre-stressed spring and coupled to the second stationary spring abutment via a pre-stressed second spring, at least the first spring configured to urge the connecting rod toward the first position, wherein movement of the connecting rod past a predetermined dead centre position between the first and second position causes at least the first spring to then urge the connecting rod toward the second position.

2. The apparatus of claim 1 further comprising a stationary abutment element configured to abut the connecting rod and prevent movement of the connecting rod past the second position.

3. The apparatus of claim 1, wherein the connecting rod includes a U-shaped receiving member to engage the crank arm in a closed position.

4. The apparatus of claim 1, wherein the first position is a closed position and the second position is an open position.

5. The apparatus of claim 1, wherein the first position is an open position and the second position is a closed position.

6. The apparatus of claim 1 wherein at least one of the spring abutments are stationary with respect to the connecting rod.

7. The device according the claim 1, wherein the spring arrangement, the mobile contact, and the jointed elements are located within a stationary housing.

8. An apparatus configured to open and close an electric power cut-off device, the apparatus comprising:

a motor;

a crank assembly rotatable about an axis, wherein operation of the motor causes rotation of the crank assembly about the axis;

a connecting rod having a first end and a second end, the connecting rod coupled to the crank assembly proximal to the first end, wherein rotation of the crank assembly causes rotational and translational movement of the connecting rod between a first position and a second position, the connecting rod including a U-shaped receiving member to engage the crank arm in a closed position;

a first stationary spring abutment positioned a first distance from the crank assembly;

a second stationary spring abutment position a second distance from the crank assembly, wherein the second distance is greater than the first distance;

a mobile element coupled to the connecting rod proximal to the second end and moveable between the first and second stationary spring abutments, the mobile element coupled to the first stationary spring abutment via a first pre-stressed spring and coupled to the second stationary spring abutment via a pre-stressed second spring, at least the first spring configured to urge the connecting rod toward the first position, wherein movement of the connecting rod past a predetermined dead centre position between the first and second position causes at least the first spring to then urge the connecting rod toward the second position.

9. The apparatus of claim 8, further comprising a stationary abutment element configured to abut the connecting rod and prevent movement of the connecting rod past the second position.

10. The apparatus of claim 8, wherein the first and second spring abutments are stationary with respect to the connecting rod.

11. The apparatus of claim 8, wherein at least one of the spring abutments are stationary with respect to the connecting rod.

12. The apparatus of claim 8, wherein at least a portion of the crank includes a toothed segment.

13. The apparatus of claim 8, wherein the motor is configured to assist and control a trajectory of the crank assembly, the motor configured to be powered by a power converter controlled by a position and speed regulator.

14. An apparatus configured to open and close an electric power cut-off device, the apparatus comprising:

a motor;

a crank assembly rotatable about an axis, wherein operation of the motor causes rotation of the crank assembly about the axis;

a connecting rod having a first end and a second end, the connecting rod coupled to the crank assembly proximal to the first end, wherein rotation of the crank assembly causes rotational and translational movement of the connecting rod between a first position and a second position;

a first stationary spring abutment positioned a first distance from the crank assembly;

a second stationary spring abutment position a second distance from the crank assembly, wherein the second distance is greater than the first distance;

a mobile element coupled to the connecting rod proximal to the second end and moveable between the first and second stationary spring abutments, the mobile element coupled to the first stationary spring abutment via a first pre-stressed spring and coupled to the second stationary spring abutment via a pre-stressed second spring, at least the first spring configured to urge the connecting rod toward the first position, wherein movement of the connecting rod past a predetermined dead centre position between the first and second position causes at least the first spring to then urge the connecting rod toward the second position; and a stationary abutment element configured to abut the connecting rod and prevent movement of the connecting rod past the second position.

15. The apparatus of claim 14, wherein the first and second spring abutments are stationary with respect to the connecting rod.

16. The apparatus of claim 14, wherein the connecting rod includes a U-shaped receiving member to engage the crank arm in a closed position.

17. The apparatus of claim 14, wherein at least one of the spring abutments are stationary with respect to the connecting rod.

18. The apparatus of claim 14, wherein at least a portion of the crank includes a toothed segment.

19. The apparatus of claim 14 wherein the motor is configured to assist and control a trajectory of the crank assembly, the motor configured to be powered by a power converter controlled by a position and speed regulator.

* * * * *